US009156605B2

(12) United States Patent
Rose et al.

(10) Patent No.: US 9,156,605 B2
(45) **Date of Patent: *Oct. 13, 2015**

(54) CONTAINER FOR SHIPPING FRAGILE PRODUCTS AND METHOD FOR MAKING THE SAME

(75) Inventors: Michael R. Rose, Franklin, TN (US); Spencer G. Miller, Shelbyville, TN (US); Ron G. Miller, Shelbyville, TN (US)

(73) Assignee: RoseMill Packaging Resources, LLC, Lewisburg, TN (US)

( * ) Notice: Subject to any disclaimer, the term of this patent is extended or adjusted under 35 U.S.C. 154(b) by 1099 days.

This patent is subject to a terminal disclaimer.

(21) Appl. No.: 13/207,095

(22) Filed: Aug. 10, 2011

(65) Prior Publication Data

US 2012/0080347 A1 Apr. 5, 2012

Related U.S. Application Data

(63) Continuation-in-part of application No. 12/894,768, filed on Sep. 30, 2010, now Pat. No. 8,403,142.

(51) Int. Cl.
*B65D 85/48* (2006.01)
*B65D 19/06* (2006.01)

(52) U.S. Cl.
CPC ..... *B65D 85/48* (2013.01); *B65D 19/06* (2013.01); *B65D 2519/00029* (2013.01); *B65D 2519/00064* (2013.01); *B65D 2519/0082* (2013.01); *B65D 2519/00099* (2013.01); *B65D 2519/00159* (2013.01); *B65D 2519/00169* (2013.01); *B65D 2519/00184* (2013.01); *B65D 2519/00273* (2013.01); *B65D 2519/00293* (2013.01); *B65D 2519/00308* (2013.01); *B65D 2519/00323* (2013.01); *B65D 2519/00333* (2013.01); *B65D 2519/00373* (2013.01); *B65D 2519/00502* (2013.01); *B65D 2519/00621* (2013.01); *B65D 2519/00666* (2013.01); *B65D 2519/00815* (2013.01); *Y10T 29/49826* (2015.01)

(58) Field of Classification Search
CPC ..... B65D 85/48; B31B 1/14; B31B 1/74
USPC ..... 206/454, 448, 449, 521; 211/41.14, 211/41.15, 41.16; 493/51, 52
See application file for complete search history.

(56) References Cited

U.S. PATENT DOCUMENTS 3,938,660 A * 2/1976 Moehring ..... 206/451
3,995,738 A * 12/1976 Rowley et al. ..... 206/451
4,010,848 A * 3/1977 Pater et al. ..... 206/448

(Continued)

*Primary Examiner* — Jacob K Ackun
*Assistant Examiner* — Jenine Pagan
(74) *Attorney, Agent, or Firm* — Armstrong Teasdale LLP

(57) ABSTRACT

A container for transporting glass sheets includes a bottom structure, a back wall and first and second side walls coupled to the back wall, all three walls extending upwardly from the bottom structure. The container also includes a back support structure coupled to the back wall that is configured to constrain a plurality of glass sheets. The back support structure includes at least one back support member that extends in a substantially vertical direction and includes at least one offset member that includes a first/second side defining a first/second length extending inwardly a first/second distance from the back support member. The second length is greater than the first length. The back support structure also includes at least one foam rail coupled to a foam rail support member. The foam rail support member is coupled to the offset member.

20 Claims, 13 Drawing Sheets

(56) References Cited

U.S. PATENT DOCUMENTS

| | | | | |
|---|---|---|---|---|
| 4,074,823 | A * | 2/1978 | Pater et al. | 414/800 |
| 5,105,946 | A | 4/1992 | McDowell | |
| 5,145,073 | A * | 9/1992 | Kitagawa et al. | 211/41.14 |
| 5,388,696 | A * | 2/1995 | Rodriguez Egana | 206/454 |
| 5,676,066 | A | 10/1997 | Cavalier et al. | |
| 5,755,339 | A * | 5/1998 | Belanger et al. | 211/41.14 |
| 6,386,376 | B1 * | 5/2002 | Mendoza-Castillo et al. | 211/41.14 |
| 6,742,663 | B2 | 6/2004 | Chubb | |
| 7,441,658 | B2 | 10/2008 | McDowell | |
| 7,533,771 | B2 * | 5/2009 | Allison | 206/448 |
| 2005/0205500 | A1 * | 9/2005 | Yamamoto et al. | 211/41.14 |
| 2006/0186118 | A1 | 8/2006 | Stojak et al. | |
| 2008/0185309 | A1 * | 8/2008 | Grigsby et al. | 206/454 |
| 2008/0283583 | A1 | 11/2008 | Hall | |
| 2009/0301916 | A1 | 12/2009 | McDowell | |
| 2010/0065518 | A1 * | 3/2010 | Noda et al. | 211/41.14 |

* cited by examiner

CONTAINER FOR SHIPPING FRAGILE PRODUCTS AND METHOD FOR MAKING THE SAME

CROSS REFERENCE TO RELATED APPLICATIONS

This application is a continuation-in-part of U.S. patent application Ser. No. 12/894,768, filed Sep. 30, 2010 now U.S. Pat. No. 8,403,142, entitled, "Container For Shipping Fragile Products and Method For Making The Same," which is incorporated by reference herein in its entirety.

BACKGROUND OF THE INVENTION

The field of the invention relates generally to a container for shipping frangible and fragile articles and more particularly, to a container for transporting a plurality of curved glass sheets, such as windshields for vehicles.

Containers for shipping glass or plexiglass sheets, such as windshields used in automobiles and trucks, are typically corrugated structures or wood crates (or a combination thereof) supported on a wood pallet. The containers are pre-assembled or occasionally shipped in components to the windshields manufacturer and are set up or assembled on-site. In at least some known glass shipping containers, bottom support and side devices include sufficient features to securely support the glass and withstand the rigors of transportation and be capable of stacking to maximize warehouse space. This includes providing a snug fit for the glass. Further, in at least some known glass shipping containers, the bottom support and side devices are constructed to at least partially withstand banding pressures from straps or bands utilized in shipping.

In at least some known cases, shipping the glass sheets in an upright position increases a propensity for the glass sheets to shift during transit, thereby stressing the banding and the portions of the container in contact with the banding. Such increased wear may decrease a life expectancy of the shipping container, and may allow for some shifting of the glass sheets resulting in at least some damage to the glass, as well as the shipping container. Moreover, some glass shipping containers provide for placing the glass sheets directly on the bottom pallet, wherein localized induced weight stresses may shorted an expected lifespan of the shipping container's bottom pallet. Further, the positioning of banding around the container is often performed in a haphazard manner because the container does not provide adequate access for routing the banding when the container is at least partially loaded with windshields.

BRIEF DESCRIPTION OF THE INVENTION

In one aspect, a container for transporting glass sheets is provided. The container defines an internal volume. The container includes a bottom structure and a back wall extending upwardly from the bottom structure. The container also includes a first side wall coupled to the back wall and extending upwardly from the bottom structure. The container further includes a second side wall opposite the first side wall coupled to the back wall and extending upwardly from the bottom structure. The container also includes a back support structure coupled to the back wall and configured to constrain a plurality of glass sheets. The back support structure includes at least one back support member. The at least one back support member extends in a substantially vertical direction. The back support member also includes at least one offset member. The offset member includes a first side defining a first length extending inwardly a first distance from the at least one back support member toward the internal volume of the container. The offset member also includes a second side defining a second length extending inwardly a second distance from the at least one back support member toward the internal volume of the container. The second length is greater than the first length. The back support member further includes at least one foam rail coupled to a foam rail support member. The foam rail support member is coupled to the at least one offset member.

In another aspect, a method of assembling a container for transporting glass sheets is provided. The container defines an internal volume. The method includes providing a bottom structure having a front edge and coupling a back wall to the bottom structure and extending the back wall upwardly therefrom. The method also includes coupling a first side wall to the back wall and extending the first side wall upwardly from the bottom structure. The method further includes coupling a second side wall to the back wall and extending the second side wall upwardly from the bottom structure, wherein the first and second side walls are opposite to each other. The method also includes coupling at least one back support member to the back wall and extending the at least one back support member in a substantially vertical direction. The method further includes forming ay least one offset member that includes forming a first side of the at least one offset member having a first length and forming a second side of the at least one offset member having a second length. The second length is greater than the first length. The method also includes coupling the at least one offset member to the at least one back support member such that the first side extends inwardly a first distance from the at least one back support member toward the internal volume of the container, and the second side extends inwardly a second distance from the at least one back support member toward the internal volume of the container. The method further includes coupling a foam rail support member to the at least one offset member. The method also includes coupling at least one foam rail to the foam rail support member.

DETAILED DESCRIPTION OF THE INVENTION

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure. The orientations as used herein are referenced to a horizontal, or x-axis 10, a vertical, or y-axis 20, and a depth, or z-axis 30.

The term "glass sheets" as used herein includes sheets made from plexiglass, glass, plastic, or other similar frangible or fragile materials, and/or combinations thereof, which are typically used to make windshields or other windows for vehicles, or glass sheets for any other application. While the windshields as alluded to herein are typically curved, the shipping container described herein may be used with glass sheets of any configuration and/or orientation.

The present invention provides a glass shipping container formed from a plurality of wooden members and corrugated cardboard. The shipping container includes a bottom, or floor support mechanism that facilitates supporting the transported glass sheets above a bottom support pallet. The floor support mechanism also enables banding straps to be routed around the glass sheets, through holes and grooves formed in an oriented strand board (OSB) member, and to an outer anchoring portion of the shipping container, thereby improving the loading and securing the glass sheets therein. The floor support mechanism is further configured to strengthen the shipping container while shifting induced weight forces though the reinforced portions of the OSB member and to a reinforced portion of the bottom support pallet. The shipping container also includes an inclined back support mechanism. Specifically, the inclined back support mechanism is angled with respect to one dimension to facilitate stacking glass sheets within the shipping container such that a substantial portion of the induced weight forces are transferred to the rear of the shipping container. Also, the inclined back support mechanism is angled with respect to another dimension to facilitate accommodating the curvature of the windshields. The shipping container further includes a top support member that strengthens the shipping container and reduces the potential for damage to the glass sheets during transport.

Figure 1:
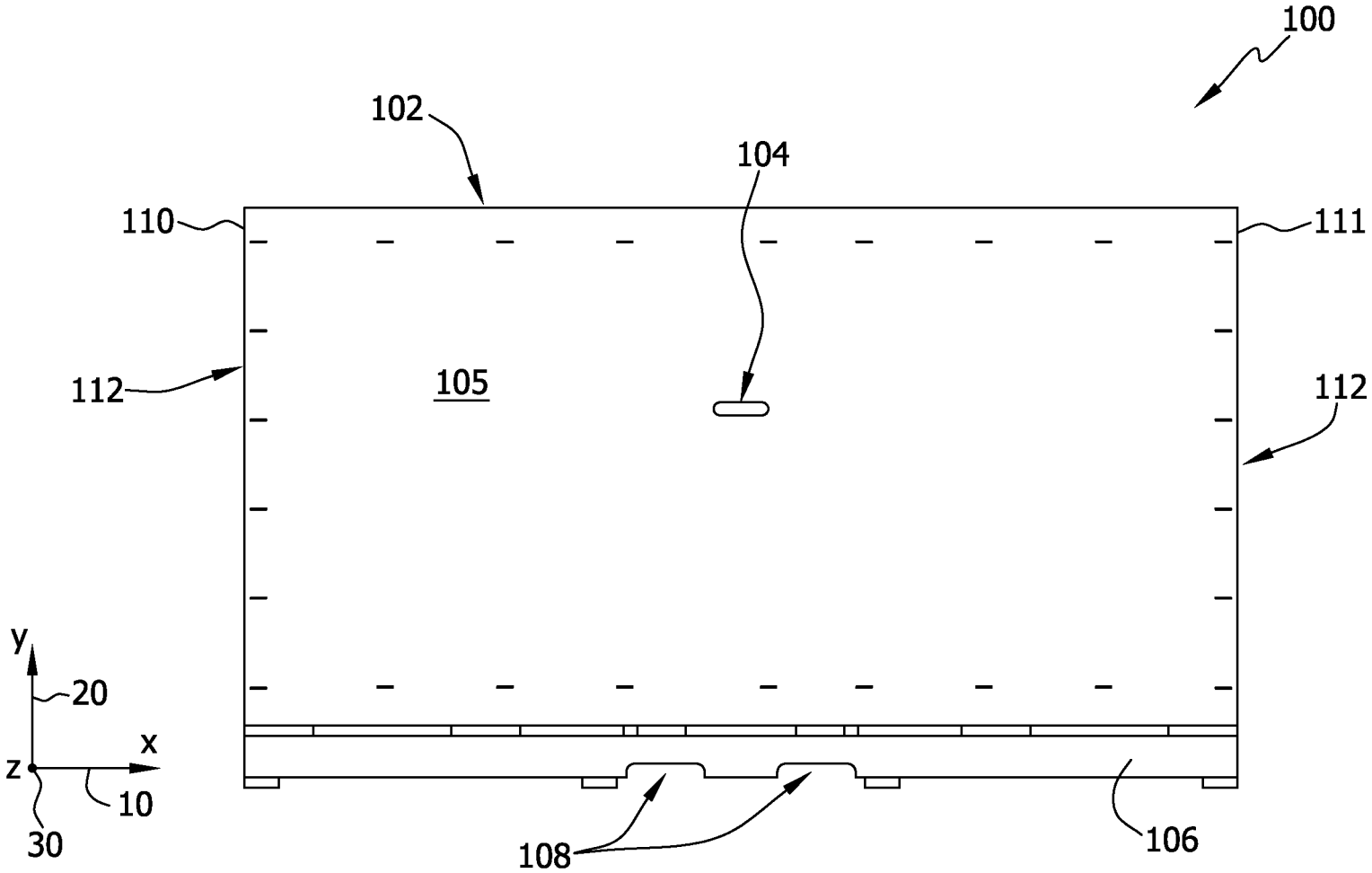
FIG. 1 is a front view of a glass shipping container according to a first embodiment of the present invention.

Referring now to the drawings, and more specifically to FIG. 1, which is a front view of an example embodiment of a container for transporting glass sheets, that is, a glass shipping container 100. X-axis 10, y-axis 20, and z-axis 30 are shown for reference, wherein z-axis 30 is shown entering and exiting the sheet. Glass shipping container 100 includes a removable front wall, or panel 102. Front panel 102 includes at least one finger-grip opening 104 for enabling a user to easily remove front panel 102, thereby improving access to the interior volume defined therein for loading and unloading container 100. In the exemplary embodiment, front panel 102 includes a corrugated cardboard wall 105. Shipping container 100 also includes a bottom structure, or a bottom support pallet 106 that is manufactured from a plurality of wood members (not shown) arranged in any configuration that enables operation of shipping container 100 as described herein. Support pallet 106 defines a plurality of fork openings 108 that facilitate transport by a fork-type transporting mechanism including, without limitation, a fork lift truck and a forked hand-cart. Support pallet 106 and front panel 102 are coupled by standard fastening mechanisms (not shown) that include, without limitation, screws, bolts, and nails. Shipping container 100 further includes a plurality of sidewalls 112, wherein each sidewall 112 includes a front portion (not shown in FIG. 1) and each sidewall extends vertically upward from support pallet 106. In the exemplary embodiment, removable front panel 102 and sidewalls 112 define a first front edge 110 and a second front edge 111, and cardboard wall 105 extends therebetween. Shipping container 100 is configured to constrain and protect a plurality of glass sheets (not shown) during transport.

In general, in the embodiments described herein, heat-treated soft wood, that is, southern yellow pine, is used for the wooden components unless otherwise stated. Alternatively, any wood materials that enable operation of shipping container 100 as described herein are used.

Figure 2:
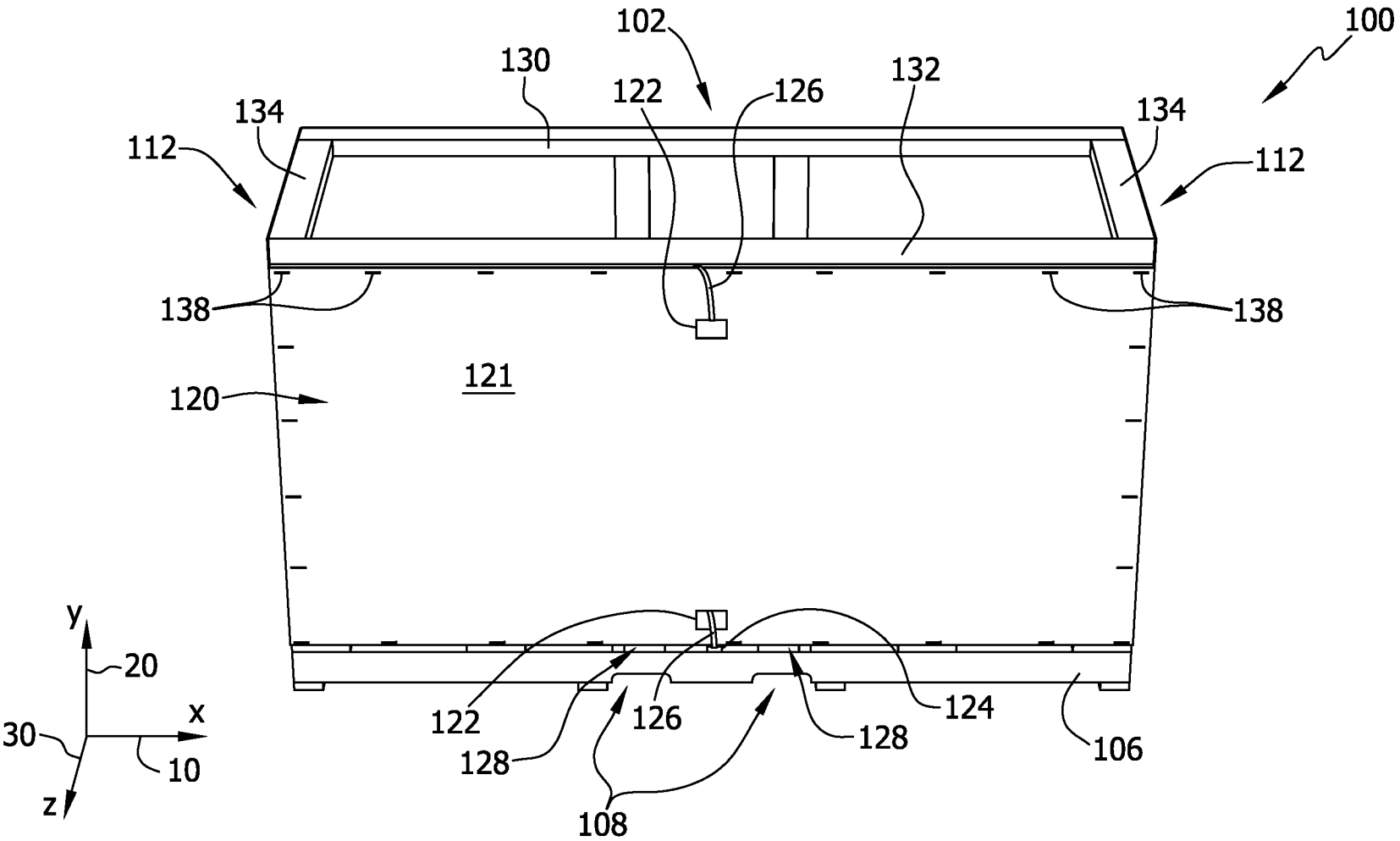
FIG. 2 is a perspective back view of the glass shipping container shown in FIG. 1.

FIG. 2 is a perspective back view of glass shipping container 100. In the exemplary embodiment, glass shipping container 100 includes a back wall, or panel 120 that extends upward from support pallet 106. X-axis 10, y-axis 20, and z-axis 30 are shown for reference. In the exemplary embodiment, back panel 120 includes a corrugated cardboard wall 121. Back panel 120 defines a plurality of banding openings 122 and support pallet 106 defines at least one banding opening 124. Openings 122 and 124 receive at least one banding 126 therethrough, wherein bandings 126 facilitate securing glass panels (not shown) within shipping container 100 during transport. Shipping container 100 also includes at least one banding aperture 128 defined therein, wherein apertures 128 extend from a position near front panel 102 to back panel 120. Apertures 128 facilitate extending banding material (not shown) from front to back to facilitate securing glass panels therein.

In the exemplary embodiment, front panel 102 includes an upper support member 130 and back panel 120 includes an upper support member 132 that is substantially parallel to support member 130, that is, substantially horizontal. Support members 130 and 132 are fabricated from substantially unitary 2-inch by 4-inch wood, that is, a 2×4. Also, in the exemplary embodiment, each of sidewalls 112 includes a support member 134, wherein both support members 134 are substantially parallel to each other. Support members 134 are fabricated from substantially unitary 2-inch by 2.25-inch wood, that is, a 2×2-¼ and are coupled to support members 130 and 132 by standard fastening mechanisms (not shown) that include, without limitation, screws, bolts, and nails. Support members 130, 132, and 134 define a substantially open top arrangement for shipping container 100. Moreover, in the exemplary embodiment, back panel 120 is coupled to support members 132 and 134 via a plurality of staples 138. Alternatively, back panel 120 is coupled to support members 132 and 134 by standard fastening mechanisms (not shown) that include, without limitation, staples, screws, bolts, and nails.

Figure 3:
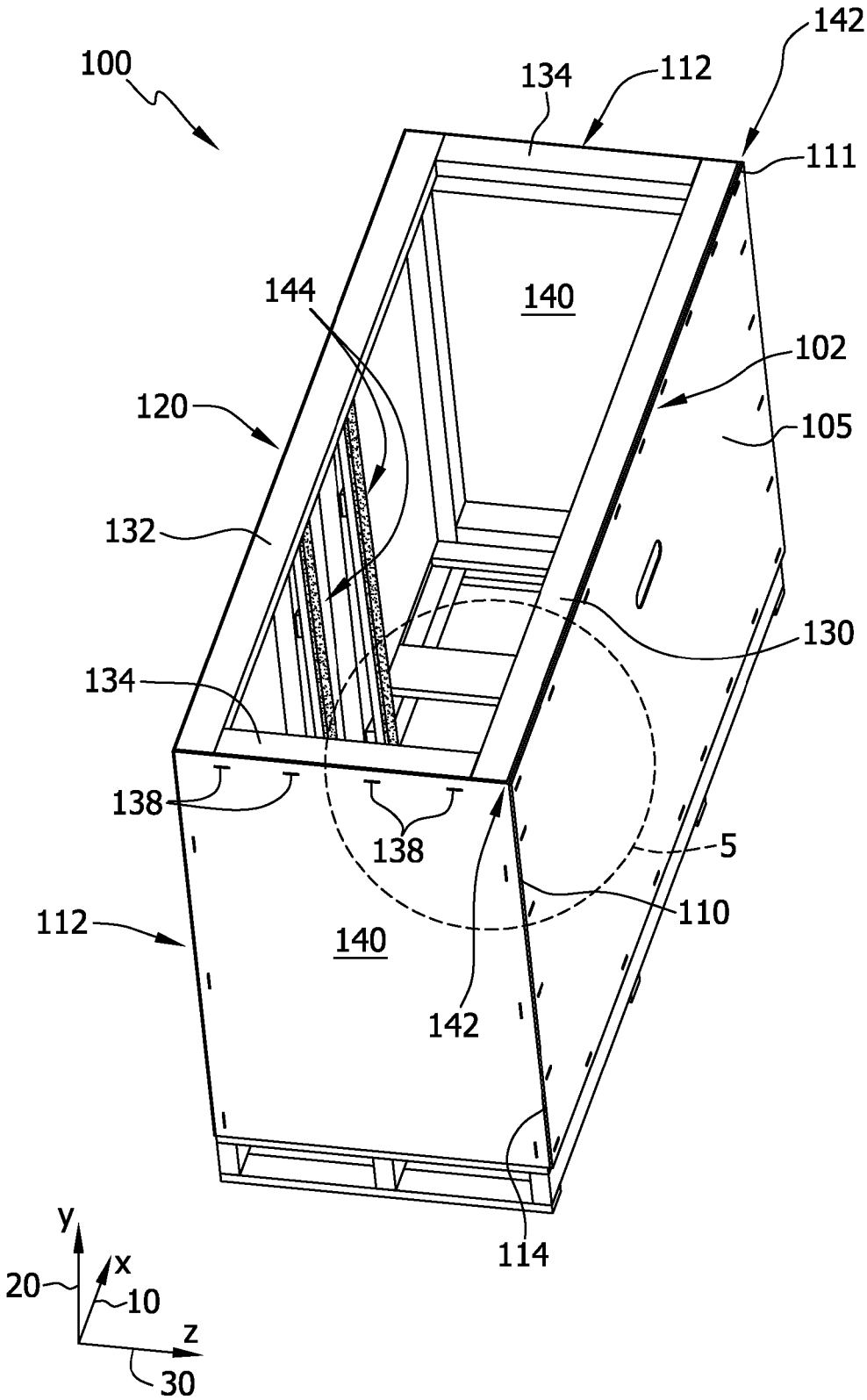
FIG. 3 is a perspective top view of the glass shipping container shown in FIGS. 1 and 2.

FIG. 3 is a perspective top view of glass shipping container 100. X-axis 10, y-axis 20, and z-axis 30 are shown for reference. In the exemplary embodiment, glass shipping container 100 includes a plurality of side panels 140 that are fabricated of corrugated cardboard and are coupled to support members 132 and 134 via a plurality of staples 138 to form sidewalls 112. Alternatively, each side panel 140 is coupled to support members 132 and 134 by standard fastening mechanisms (not shown) that include, without limitation, staples, screws, bolts, and nails. Side panels 140 are not coupled to support member 130, thereby facilitating removability features of front panel 102. Front portion 114 of sidewalls 112, each side panel 140, and cardboard wall 105 cooperate to define a corrugated lip 142 that facilitates holding support member 130 in place when front panel 102 is inserted into shipping container 100. Also, in the exemplary embodiment, glass shipping container 100 includes at least one angled back rest, that is, back support mechanism 144 that facilitates support of glass plates (not shown) in shipping container 100 during transport.

Figure 4:
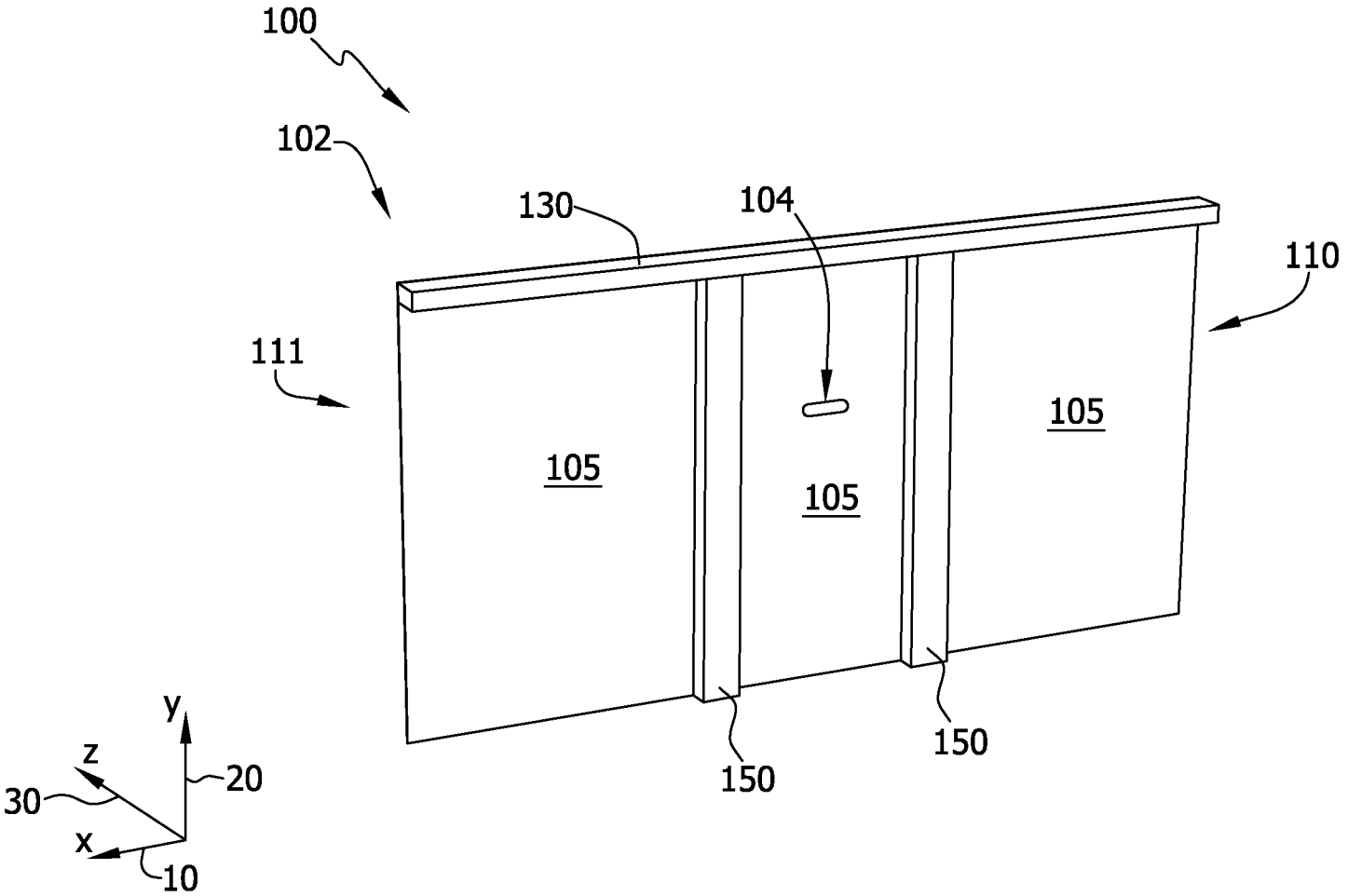
FIG. 4 is a perspective view of a front panel that is used with the glass shipping container shown in FIG. 1 and removed therefrom.

FIG. 4 is a perspective view of front panel 102 of glass shipping container 100 and removed therefrom. X-axis 10, y-axis 20, and z-axis 30 are shown for reference. This perspective view shows the interior surface of front panel 102. Front panel 102 includes a plurality of vertical support members 150 that facilitate stabilizing and strengthening front panel 102. Support members 150 are made of unitary wood 2×4s and are coupled to corrugated cardboard wall 105 via any coupling mechanism that enables operation of shipping container 100 as described herein including, without limitation, adhesives and staples.

Figure 5:
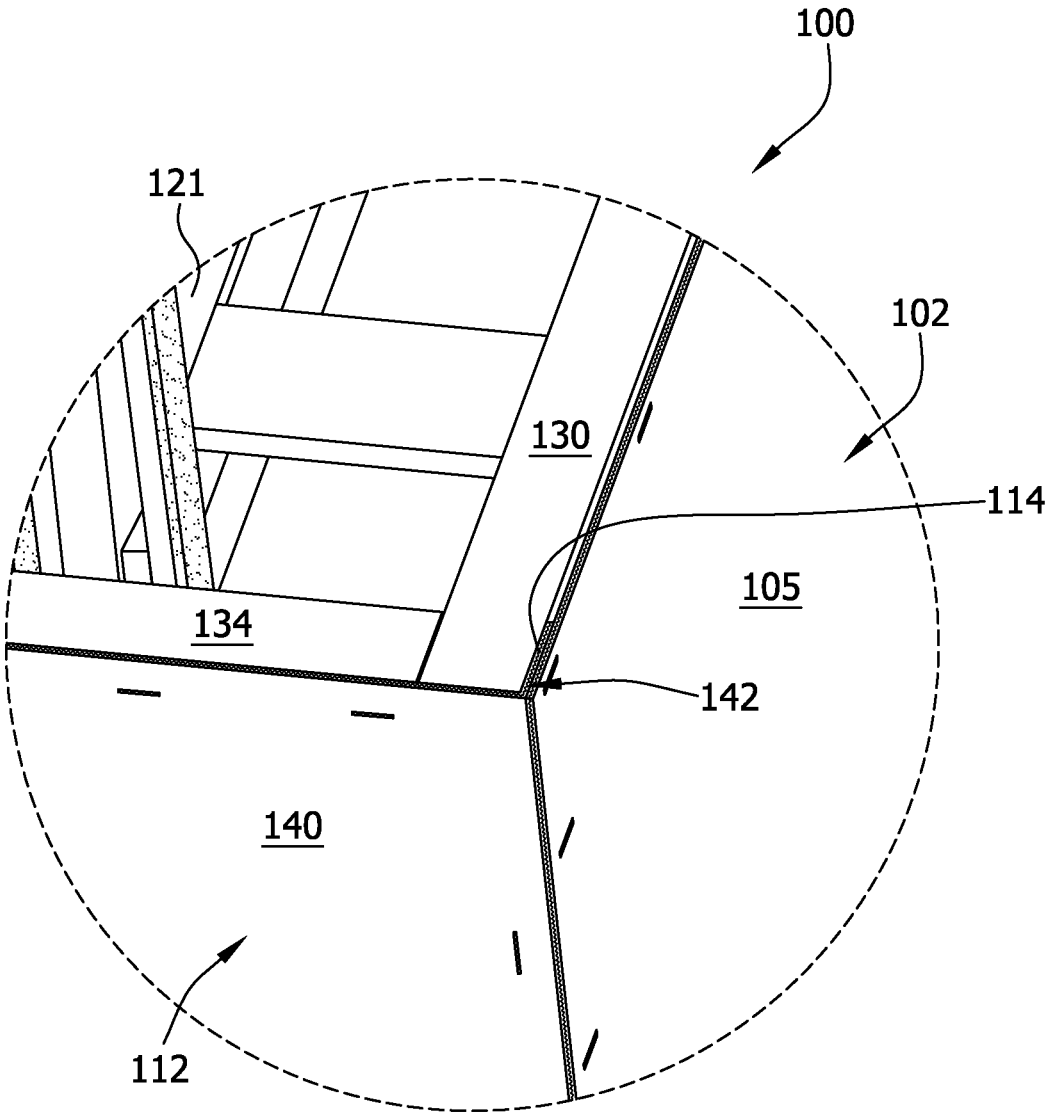
FIG. 5 is a perspective view of a corrugated lip that is used with the glass shipping container shown in FIG. 3 and taken along area 5.
Figure 6:
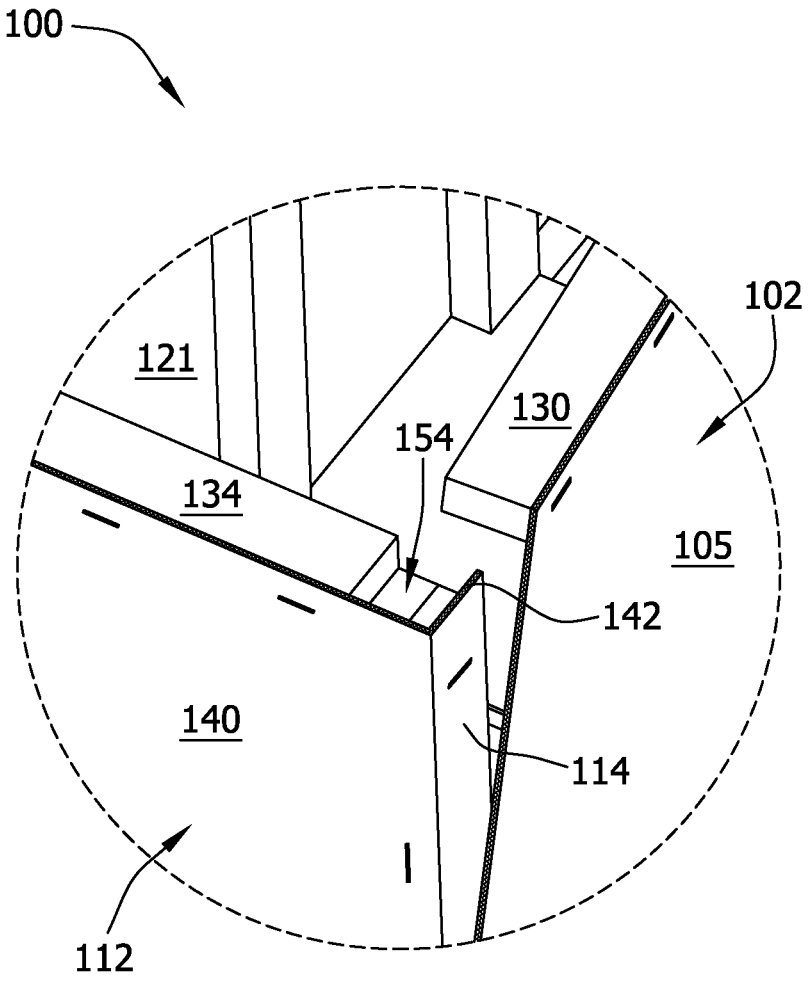
FIG. 6 is a perspective view of the corrugated lip shown in FIG. 5 with the front panel shown in FIG. 4 partially removed.

FIG. 5 is a perspective view of corrugated lip 142 of glass shipping container 100 taken about area 5 (shown in FIG. 3). FIG. 6 is a perspective view of corrugated lip 142 with the front panel 102 partially removed. Front portion 114 of sidewall 112 is folded over to be substantially perpendicular to side panel 140 and parallel to cardboard wall 105. In the exemplary embodiment, front portion 114 is coupled to a front corner vertical support member (not shown in FIGS. 5 and 6) via any coupling mechanism that enables operation of shipping container 100 as described herein including, without limitation, adhesives and staples. Also, in the exemplary embodiment, cardboard wall 105 is coupled to front portion 114 via any coupling mechanism that enables operation of shipping container 100 as described herein including, without limitation, adhesives and staples. Support member 134, side panel 140, front portion 114, cardboard wall 105, and corrugated lip 142 at least partially form a cavity 154 that receives a portion of front support member 130.

Figure 7:
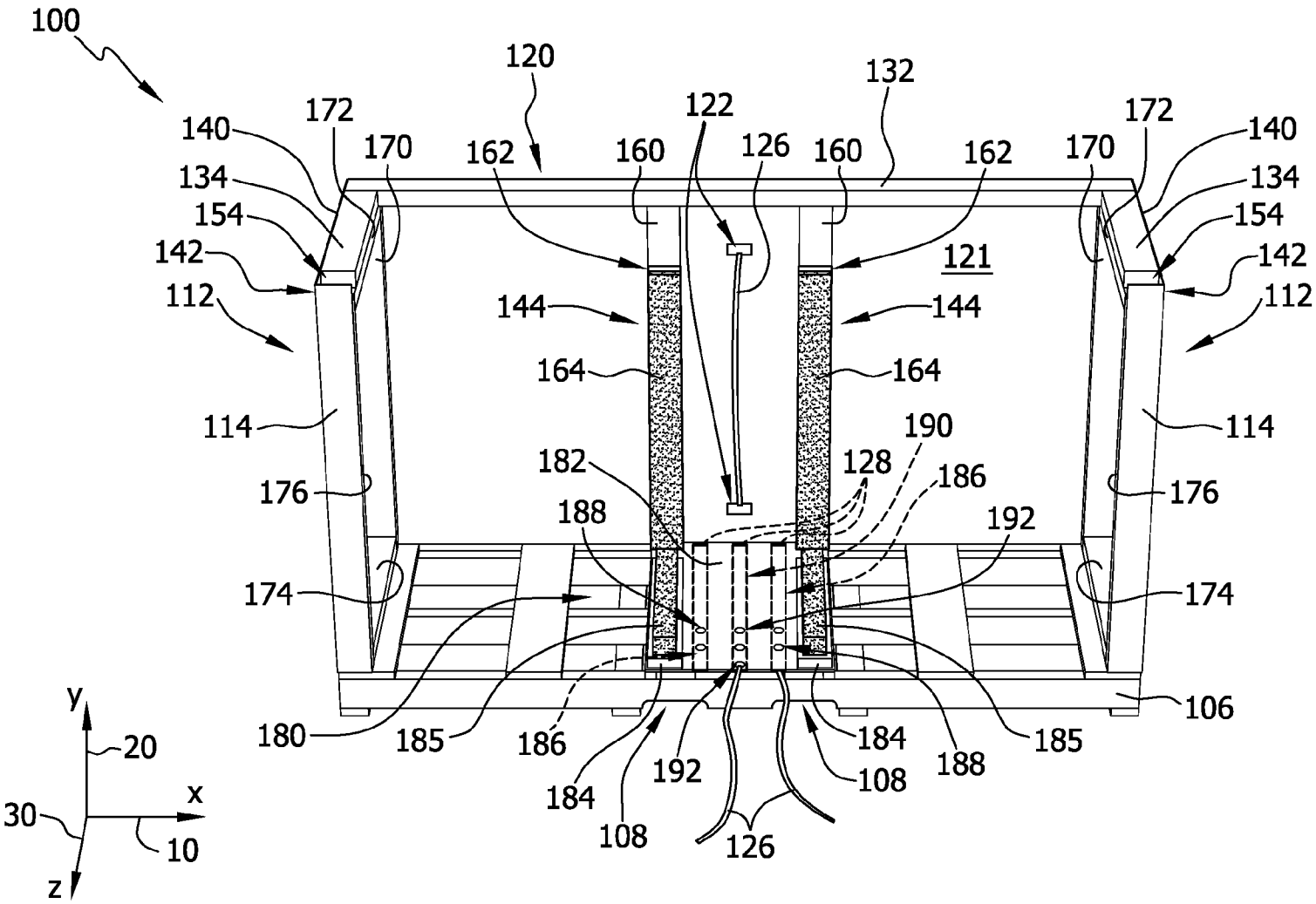
FIG. 7 is a front view of the glass shipping container shown in FIG. 1 with the front panel shown in FIG. 4 removed therefrom.

FIG. 7 is a front view of glass shipping container 100 with front panel 102 (shown in FIG. 4) removed therefrom. X-axis 10, y-axis 20, and z-axis 30 are shown for reference. In the exemplary embodiment, at least one back support mechanism 144 is coupled to back panel 120, or more specifically, coupled to corrugated cardboard wall 121 and back support member 132 by any means that enables operation of shipping container 100 as described herein.

Also, in the exemplary embodiment, glass shipping container 100 includes two back support mechanisms 144. Alternatively, any number of back support mechanisms 144 is used to enable operation of shipping container 100 as described herein, including, without limitation, one and three mechanisms 144. In the exemplary embodiment, each back support mechanism 144 is an angled backrest that has an approximately five degree incline (not shown in FIG. 7, however, described further below) with respect to y-axis 20 in the y-z plane that is facilitated by a plurality of offsets (not shown in FIG. 7, however, described further below). Each back support mechanism 144 includes a substantially vertical back support member 160 that is a wooden 2×4. Each member 160 extends from horizontal back support member 132 to a floor support mechanism 180 (discussed further below). Moreover, each member 160 is coupled to at least one of corrugated cardboard wall 121, back support member 132, and/or floor support mechanism 180 by any means that enables operation of shipping container 100 as described herein.

Each back support mechanism 144 also includes a foam rail support member 162 (shown in phantom in FIG. 7) coupled to vertical back support member 160 by any means that enables operation of shipping container 100 as described herein including, without limitation, fastening hardware and adhesives. Each foam rail support member 162 is a wooden 1-inch by 4-inch member, that is, a wooden 1×4 that extends from a predetermined distance below horizontal back support member 132 to floor support mechanism 180. Each back support mechanism 144 further includes at least one foam rail 164 coupled to foam rail support member 162 by any means that enables operation of shipping container 100 as described herein including, without limitation, fastening hardware and adhesives. Each foam rail 164 extends from a predetermined distance below horizontal back support member 132 to floor support mechanism 180. In the exemplary embodiment, foam rail 164 and foam rail support member 162 have substantially similar vertical lengths.

Further, in the exemplary embodiment, glass shipping container 100 includes a plurality of rear corner vertical support members 170, wherein each support member 170 is a unitary 2×2-¼ wooden member. Each support member 170 is coupled to corrugated cardboard wall 121 and a side panel 140 by any means that enables operation of shipping container 100 as described herein including, without limitation, staples and adhesives. Moreover, shipping container 100 includes a plurality of upper horizontal side support members 172 and a plurality of lower horizontal side support members 174. Each of support members 172 and 174 is also a unitary 2×2-¼ wooden member that is coupled to a support member 170 by any means that enables operation of shipping container 100 as described herein including, without limitation, fastening hardware and adhesives. Each of members 172 and 174 may be coupled to a side panel 140 by any means that enables operation of shipping container 100 as described herein including, without limitation, staples and adhesives. Furthermore, each upper horizontal side support member 172 is coupled to an adjacent sidewall support member 134 and each horizontal side support member 174 is coupled to bottom support pallet 106, wherein such coupling is performed by any means that enables operation of shipping container 100 as described herein including, without limitation, fastening hardware and adhesives.

Moreover, in the exemplary embodiment, glass shipping container 100 includes a plurality of front corner vertical support members 176, wherein each support member 176 is a unitary 2×2-¼ wooden member. Each support member 176 is coupled to one support member 172 and one support member 174 by any means that enables operation of shipping container 100 as described herein including, without limitation, fastening hardware and adhesives. Support members 176 may be coupled to a side panel 140 and front portion sidewalls 114 by any means that enables operation of shipping container 100 as described herein including, without limitation, staples and adhesives.

Use of unitary 2×2-¼ wooden members for support members 170, 172, 174, and 176 facilitate increasing a storage/shipping region within glass shipping container 100 and access thereto in contrast to standard wooden 2×4s and 2×3s. Moreover, sidewalls 114 may or may not include additional support members.

Also, in the exemplary embodiment, glass shipping container 100 includes floor support mechanism 180. Floor support mechanism 180 includes a floor support member, that is, a horizontal support board 182 that is fabricated from oriented strand board (OSB) material, wherein OSB material provides sufficient strength and durability for repeated shipping use with a relatively low cost as compared to other materials, such as plywood and plastic. Horizontal support board 182 is coupled to bottom support pallet 106 by any means that enables operation of shipping container 100 as described herein including, without limitation, fastening hardware and adhesives. Also, horizontal support board is substantially laterally centered on pallet 106 and extends approximately from back panel 120 to front panel 102.

Floor support mechanism 180 also includes at least one of unitary 1×4 wooden foam rail support member 184 (two shown in phantom in FIG. 7) that extend approximately from vertical foam rails 164 to proximately front panel 102. Foam rail support members 184 are coupled to horizontal support board 182 by any means that enables operation of shipping container 100 as described herein including, without limitation, fastening hardware and adhesives. Foam rail support members 184 may also be coupled to an adjacent vertical support member 162 by any means that enables operation of shipping container 100 as described herein including, without limitation, fastening hardware and adhesives.

Floor support mechanism 180 further includes at least one foam rail 185 that extends proximately from vertical foam rails 164. Foam rail 185 is coupled to a foam rail support member 184 by any means that enables operation of shipping container 100 as described herein including, without limitation, fastening hardware and adhesives. Further, in the exemplary embodiment, glass shipping container 100 includes two rail support members 184 and two foam rails 185. Alternatively, any number of support members 184 and rails 185 are used to enable operation of shipping container 100 as described herein, including, without limitation, one and three. In the exemplary embodiment, foam rail support member 182 extends to a point between a front edge (not shown in FIG. 7) of foam rail 185 and an outer front edge (not shown in FIG. 7) of horizontal support board 182. Such configuration of support member 182 and foam rail 185 facilitates lifting glass sheets (not shown) away from horizontal support board 182, thereby facilitating extending a useful life of board 182 by reducing a potential for wear of board 182 due to direct contact between the glass sheets and board 182. Moreover, since the glass sheets rest on foam rails 185, a substantial portion of weight forces induced by the glass is transferred to the foam, such foam being easy and inexpensive to replace.

Floor support mechanism 180 further includes a plurality of banding guide channels, or grooves 186 that are operatively coupled to a plurality of banding access apertures, or holes 188, wherein both grooves 186 and holes 188 are defined within horizontal support board 182. Further, grooves 186 define banding apertures 128, therefore apertures 128 are also defined in horizontal support board 182. Therefore, holes 188 are operatively coupled to apertures 128 via grooves 186, facilitate channeling banding 126 throughout the bottom portion of glass shipping container 100, thereby facilitating support of glass sheets (not shown) therein throughout transit. One embodiment of shipping container 100 includes two holes 188 for each groove 186, wherein each grove is inboard from, and adjacent to, a foam rail 184. An alternative embodiment of shipping container 100 includes three holes 192 for a single groove 190, wherein both holes 192 and groove 190 are aligned about an approximate center of horizontal support board 182. Further, alternatively, any number of holes 188 and 192 and any number of grooves 186 and 190 are formed within horizontal support board 182 that enables operation of shipping container 100 as described herein.

Figure 8:
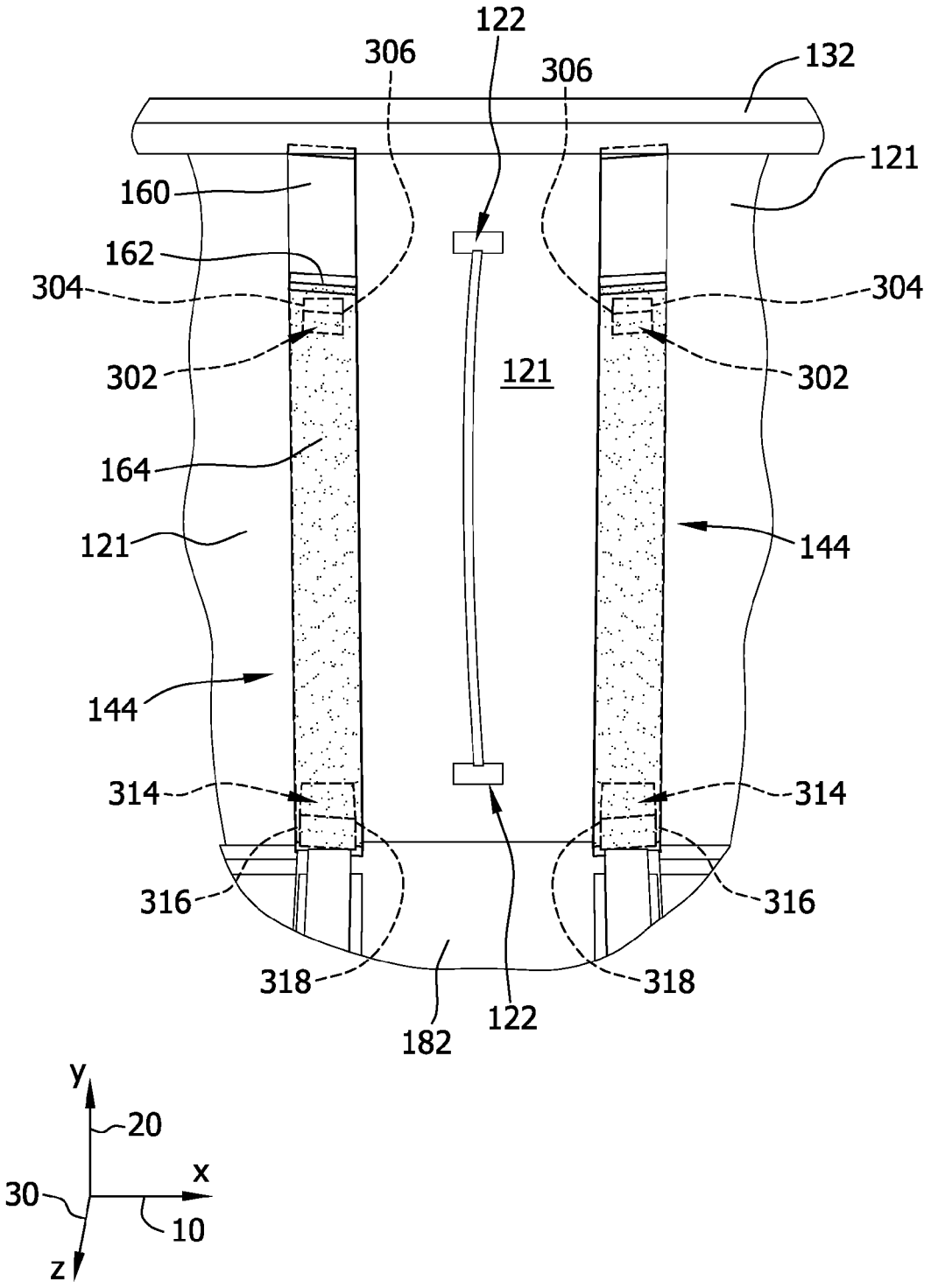
FIG. 8 is a front view of a back support mechanism that is used with the glass shipping container shown in FIG. 1.
Figure 9:
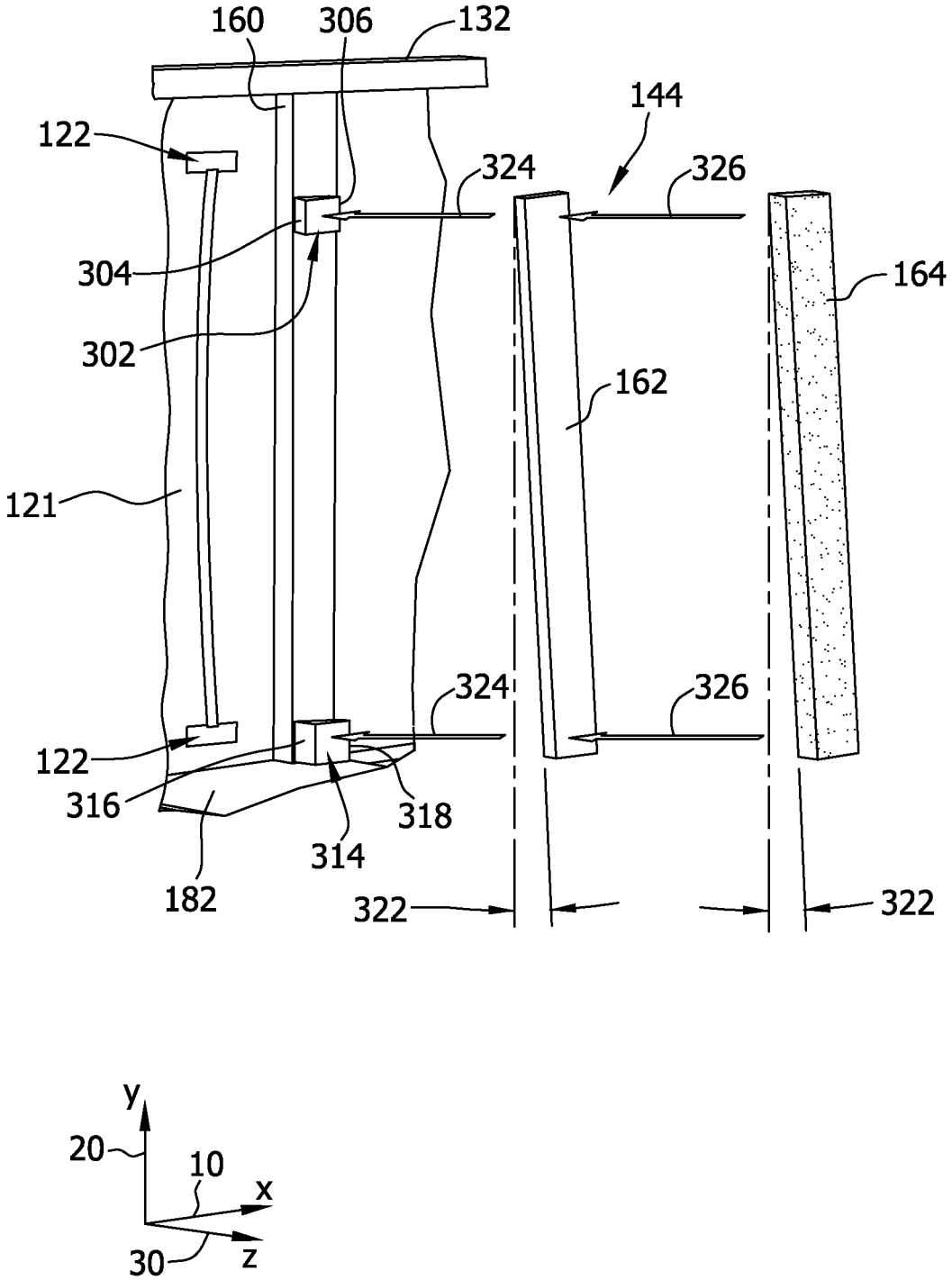
FIG. 9 is a perspective side view of the back support mechanism shown in FIG. 8.
Figure 10:
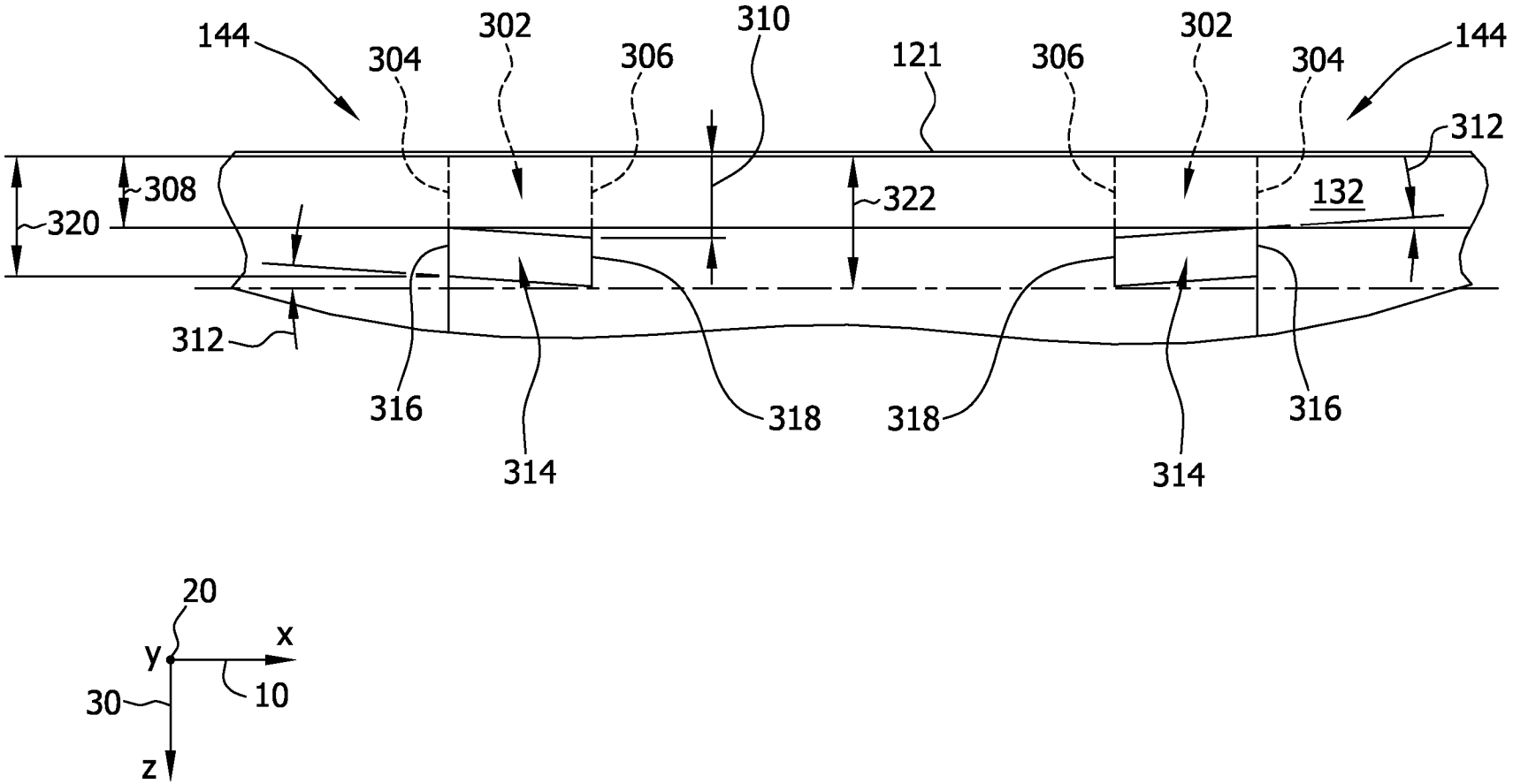
FIG. 10 is an overhead view of the back support mechanism shown in FIGS. 8 and 9.

FIG. 8 is a front view of back support mechanism 144 that is used with glass shipping container 100 (shown in FIG. 1). X-axis 10, y-axis 20, and z-axis 30 are shown for reference. FIG. 9 is a perspective side view of back support mechanism 144. X-axis 10, y-axis 20, and z-axis 30 are shown for reference. FIG. 10 is an overhead view of back support mechanism 144. X-axis 10, y-axis 20, and z-axis 30 are shown for reference, wherein y-axis 20 is shown entering and exiting the sheet.

In the exemplary embodiment, each back support mechanism 144 includes a first, or upper offset member 302. Upper offset member 302 includes a first side 304 and a second side 306. First side 304 and second side 306 are substantially parallel to y-axis 20. First side 304 has a first outside length 308 and second side 306 has a first inside length 310, wherein both lengths 308 and 310 extend from vertical back support member 160 into the interior volume of shipping container 100. First inside length 310 is greater than first outside length 308. Moreover, first outside length 308 and first inside length 310 have length values that define an angle 312 with respect to x-axis (10) in the x-z plane. Also, in the exemplary embodiment, angle 312 has a value in a range between approximately 3 degrees and approximately 5 degrees, with a preferred angle of approximately 4 degrees, to facilitate acceptance of the curvature of windshields (not shown). Alternatively, angle 312 has any value that enables operation of glass shipping container 100 as described herein. Upper offset member 302 is coupled to vertical back support member 160 by any means that enables operation of shipping container 100 as described herein including, without limitation, fastening hardware and adhesives, proximate to a top of foam rail support members 162 and foam rails 164.

Back support mechanism 144 also includes a second, or lower offset member 314. Lower offset member 314 includes a first side 316 and a second side 318. First side 316 and second side 318 are substantially parallel to y-axis 20, and are parallel to sides 304 and 306, respectively, of upper offset member 302. Moreover, first side 316 and second side 318 are at least partially coincidental with planes defined by sides 304 and 306, respectively. First side 316 has a second outside length 320 and second side 318 has a second inside length 322, wherein both lengths 320 and 322 extend from vertical back support member 160 into the interior volume of shipping container 100. Second inside length 322 is greater than second outside length 320. Also, second inside length 322 is greater than first inside length 310 and second outside length 320 is greater than first outside length 308. Moreover, second outside length 320 and second inside length 322 have length values that cooperate with first outside length 308 and first inside length 310, respectively, to define angle 312 with respect to x-axis (10) in the x-z plane.

In addition to defining angle 312, first outside length 308, second outside length 320, first inside length 310, and second inside length 322 have values that define each back support mechanism 144 as an angled backrest. Upper offset member 302 and lower offset member 314 define an incline, or offset angle 322 with respect to y-axis 20 in the y-z plane. In the exemplary embodiment, offset angle 322 has a value of approximately five degrees. Alternatively, offset angle 322 has any value that enables operation of shipping container 100 as described herein.

Lower offset member 314 rests upon and is coupled to horizontal support board 182 by any means that enables operation of shipping container 100 as described herein including, without limitation, fastening hardware and adhesives. Also, lower offset member 314 rests against vertical back support member 160 such that lower offset member 314 is coupled to vertical back support member 160 by a pressure, or friction fit. Alternatively, lower offset member 314 is coupled to vertical back support member 160 by any means that enables operation of shipping container 100 as described herein including, without limitation, fastening hardware and adhesives.

Also, in the exemplary embodiment, offset members 302 and 314 are unitary wooden members. Alternatively, offset members 302 and 314 have any configuration that enables operation of shipping container 100 as described herein including, without limitation, at least one portion of a 2×4 or a plurality of portions of 2×4 coupled together. Moreover, offset members 302 and 314 have any shape that enables operation of shipping container 100 as described herein including, without limitation, rectangular and trapezoidal.

Foam rail support member 162 is coupled to each of upper and lower offset members 302 and 314, respectively, as shown by arrow 324 and foam rail 164 is coupled to support member 162 as shown by arrow 326, thereby inclining foam rail support member 162 and foam rail 164 by offset angle 322. Inclined back support mechanism 144 facilitates stacking glass sheets (not shown) within shipping container 100 such that a substantial portion of induced weight forces are transferred to a rearward portion of shipping container 100.

Figure 11:
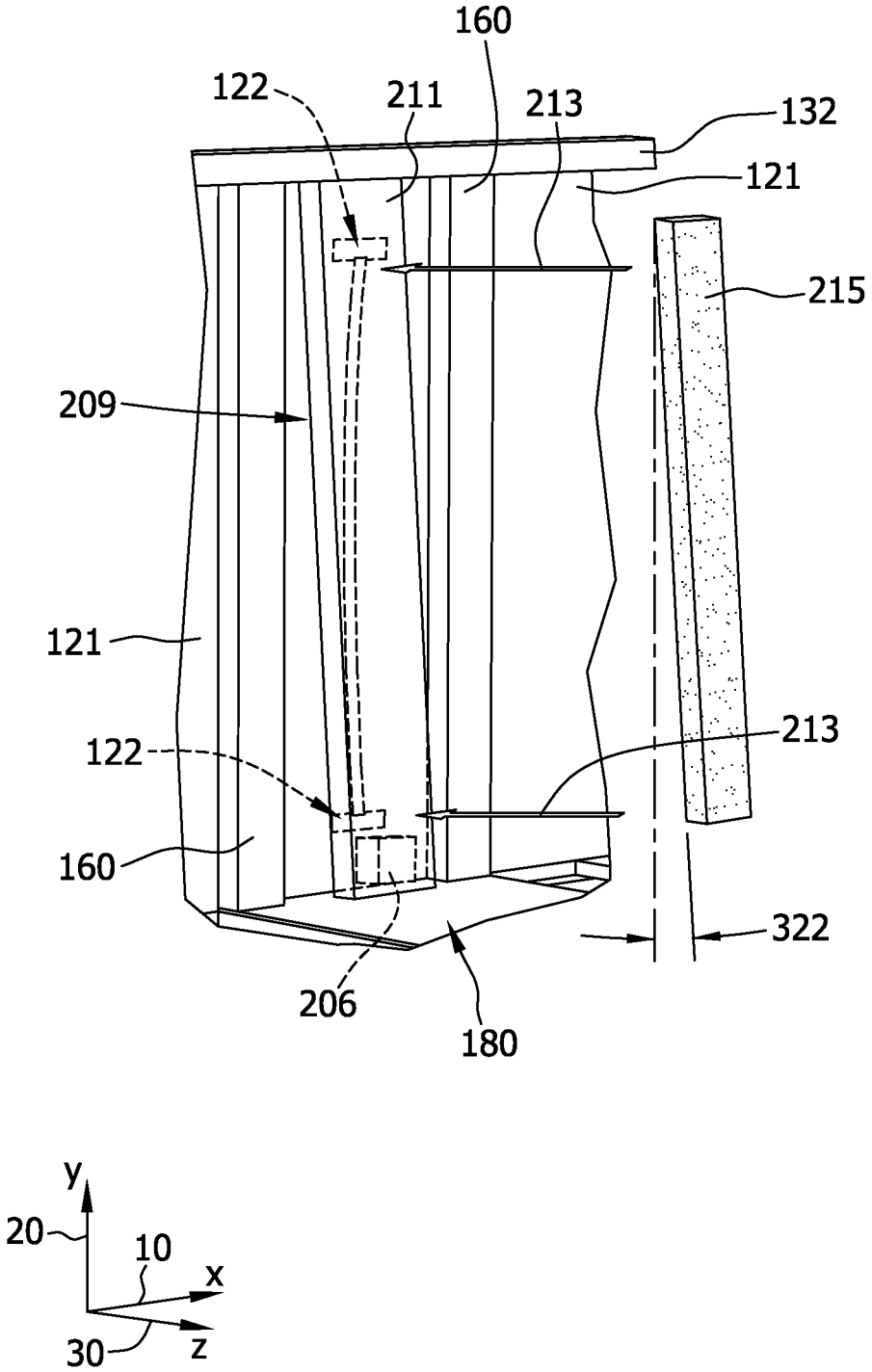
FIG. 11 is a perspective side view of an alternative back support mechanism that may be used with the glass shipping container shown in FIG. 1.

FIG. 11 is a perspective side view of an alternative back support mechanism 209 that may be used with glass shipping container 100 (shown in FIG. 1). X-axis 10, y-axis 20, and z-axis 30 are shown for reference. In this exemplary alternative embodiment, a single back support mechanism 209 is coupled to back panel 120 (shown in FIG. 7), or more specifically, coupled to at least one of corrugated cardboard wall 121 and back support member 132 by any means that enables operation of shipping container 100 as described herein. Alternatively, any number of back support mechanisms 209 is used to enable operation of shipping container 100 as described herein, including, without limitation, two and three mechanisms 209. In the exemplary embodiment, each back support mechanism 209 is an angled backrest that has an approximately five degree incline 322 that is facilitated by a single, substantially rectangular, offset member 206. Alternatively, offset member 206 may be beveled on the sides parallel to y-axis 20 to accommodate the curvature of the windshields.

Each back support mechanism 209 also includes a foam rail support member 211 coupled to at least one of corrugated cardboard wall 121, back support member 132, and/or floor support mechanism 180 by any means that enables operation of shipping container 100 as described herein. Each foam rail support member 211 is a wooden 2-inch by 6-inch member, that is, a wooden 2×6 that extends from horizontal back support member 132 to floor support mechanism 180. Each back support mechanism 209 further includes at least one foam rail 215 coupled to foam rail support member 211 as shown by arrow 213 by any means that enables operation of shipping container 100 as described herein including, without limitation, fastening hardware and adhesives. Each foam rail 215 extends from a predetermined distance below horizontal back support member 132 to floor support mechanism 180.

Figure 12:
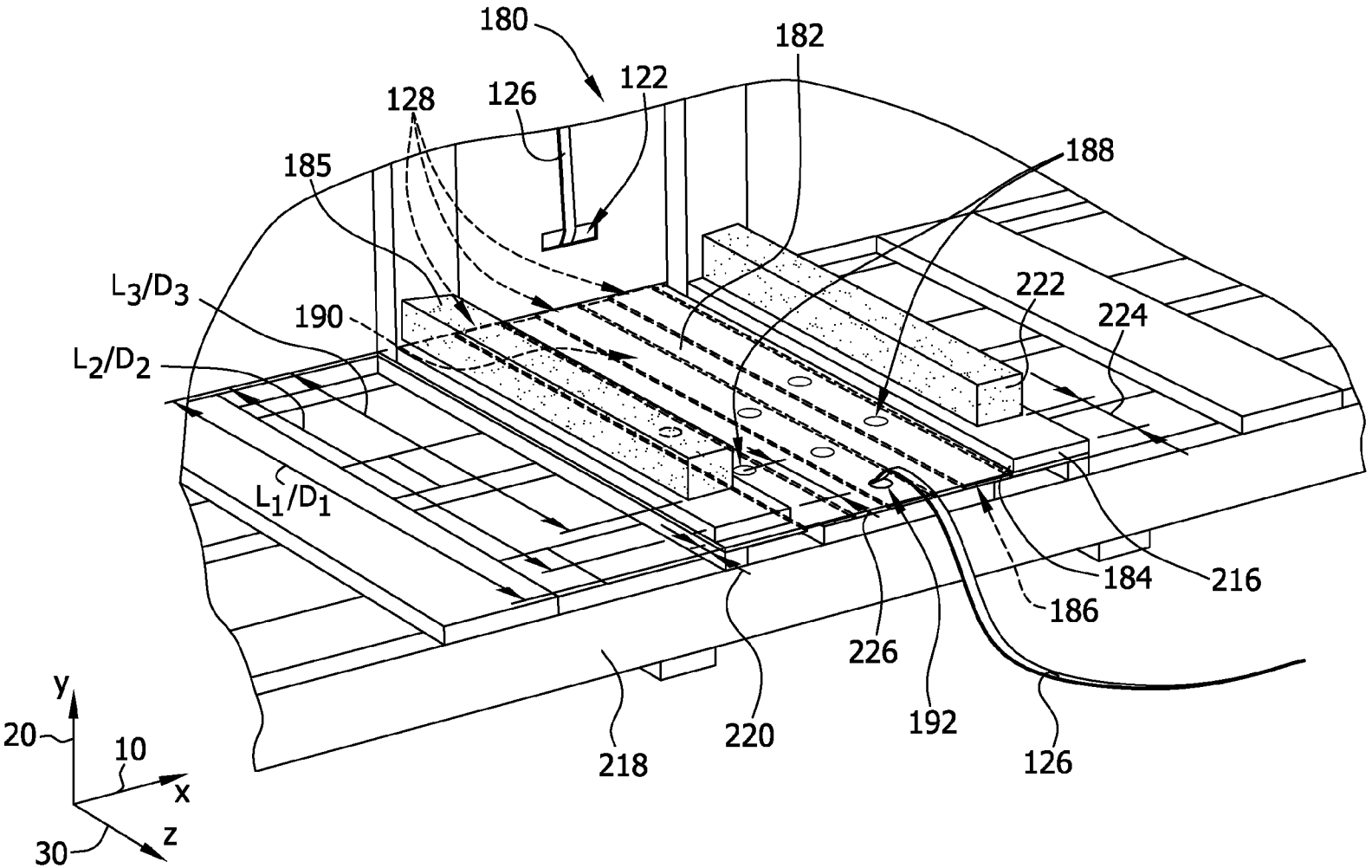
FIG. 12 is a perspective view of a floor support mechanism that is used with the glass shipping container shown in FIG. 1.
Figure 13:
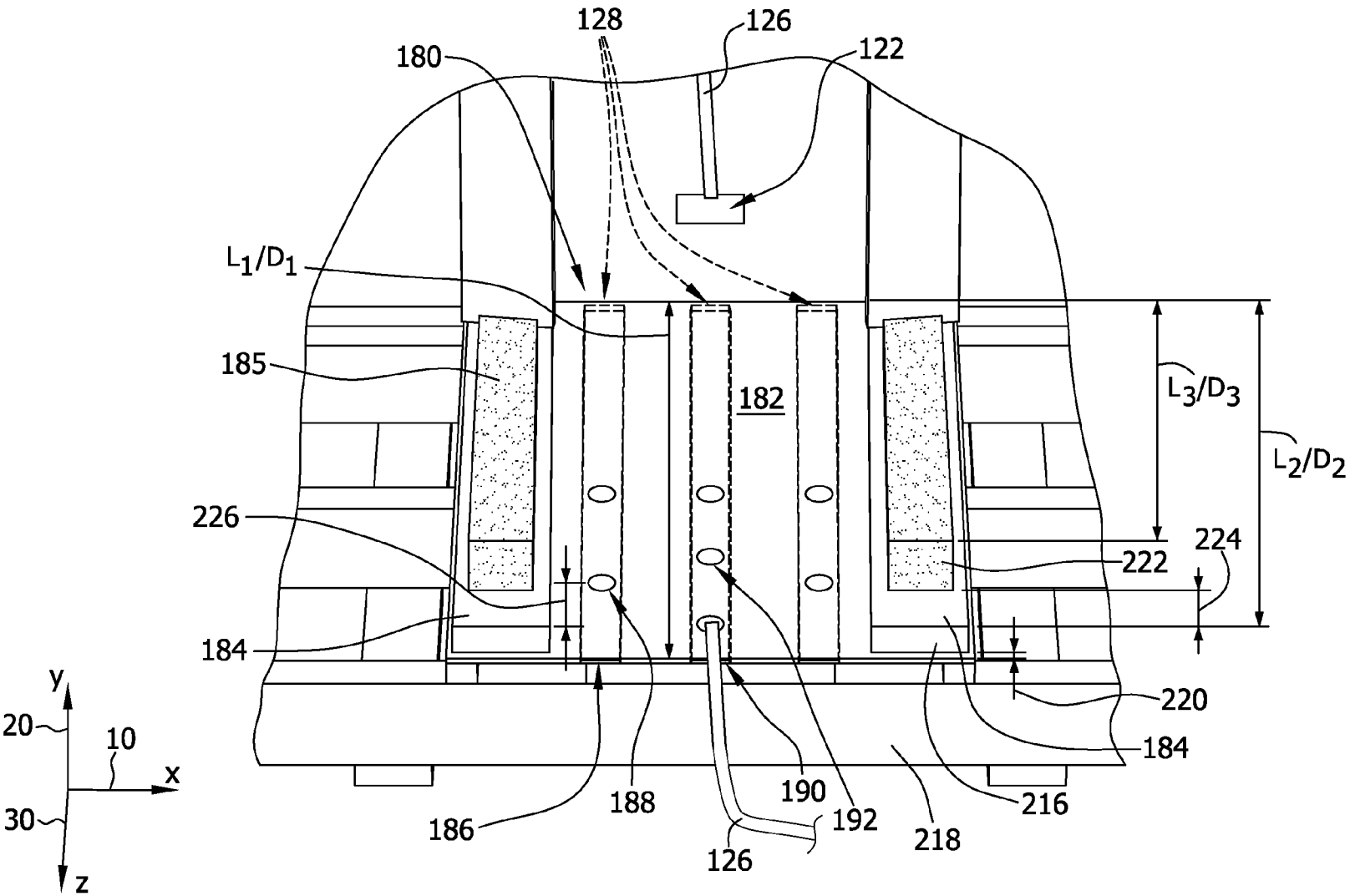
FIG. 13 is a front perspective view of the floor support mechanism shown in FIG. 12.

FIG. 12 is a perspective view of floor support mechanism 180 that is used with glass shipping container 100 (shown in FIG. 1). X-axis 10, y-axis 20, and z-axis 30 are shown for reference. FIG. 13 is a front perspective view of floor support mechanism 180. X-axis 10, y-axis 20, and z-axis 30 are shown for reference.

In the exemplary embodiment, both horizontal support board 182 and bottom support pallet 106 have a first length $L_1$ that defines a first distance $D_1$ from back panel 120 to an outer front edge 218 of bottom support pallet 106. Also, in the exemplary embodiment, foam rail support member 184 has a second length $L_2$ that defines a second distance $D_2$ from back panel 120 and foam rail support member 184 includes an outer edge 216 that is proximate to outer front edge 218. Edges 216 and 218 and distances $D_1$ and $D_2$ define a distance 220 therebetween. Moreover, foam rail 186 has a third length $L_3$ that defines a third distance $D_3$ from back panel 120 and foam rail 186 includes an outer edge 222 that defines a distance 224 between edges 222 and 216 and $D_2$ and $D_3$. Distance 224 facilitates shifting induced weight forces from substantially transferring to horizontal support board 182 to transferring to a more robust portion of bottom support pallet 106 within distance 224. Furthermore, such stresses are shifted away from a portion of OSB horizontal support board 182 in the vicinity of banding guide holes 188, wherein an ability to withstand such stresses may be diminished, that is, a predetermined distance 226 between a front-most hole 188 and edge 216 of foam rail support member 184. Distances 220, 224, and 226 have any values that enable operation of shipping container 100 as described herein.

The above-described container provides a glass shipping container formed from a plurality of wooden members and corrugated cardboard. More specifically, the shipping container as described herein includes a bottom, or floor support mechanism that facilitates supporting the transported glass sheets above a bottom support pallet. Also, the floor support mechanism enables banding straps to be routed around the glass sheets, through holes and grooves formed in an oriented strand board (OSB) member, and to an outer anchoring portion of the shipping container, thereby improving the loading and securing the glass sheets therein. Further, specifically, the floor support mechanism is configured to strengthen the shipping container while shifting induced weight forces though the reinforced portions of the OSB member and to a reinforced portion of the bottom support pallet. Moreover, the shipping container as described herein includes an inclined back support mechanism. Specifically, the inclined back support mechanism is angled with respect to one dimension to facilitate stacking glass sheets within the shipping container such that a substantial portion of the induced weight forces are transferred to the rear of the shipping container. Also, the inclined back support mechanism is angled with respect to another dimension to facilitate accommodating the curvature of the windshields. The shipping container as described herein further includes a top support member that strengthens the shipping container and reduces the potential for damage t the glass sheets during transport.

Exemplary embodiments of a container formed to contain glass sheets therein are described above in detail. The container is not limited to the specific embodiments described herein, but rather, components of the container may be utilized independently and separately from other components described herein. For example, the container features may also be used in combination with other types of containers, and is not limited to practice with only rectangular containers, as described herein. Rather, the exemplary embodiment can be implemented and utilized in connection with many other container applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A container for transporting glass sheets, said container defining an internal volume and comprising:

a bottom structure;

a back wall extending upwardly from said bottom structure;

a first side wall coupled to said back wall and extending upwardly from said bottom structure;

a second side wall opposite said first side wall coupled to said back wall and extending upwardly from said bottom structure; and a back support structure coupled to said back wall and configured to constrain a plurality of glass sheets, said back support structure comprising:

at least one back support member, said at least one back support member extending in a substantially vertical direction;

at least one offset member comprising:

a first side defining a first length extending inwardly a first distance from said at least one back support member toward the internal volume of said container; and a second side defining a second length extending inwardly a second distance from said at least one back support member toward the internal volume of said container, wherein said second length is greater than said first length; and at least one foam rail coupled to a foam rail support member, said foam rail support member is coupled to said at least one offset member.

2. A container for transporting glass sheets in accordance with claim 1, wherein said at least one offset member defines an outside portion facing one of said first and second side walls and an opposing inside portion, said at least one offset member comprises:

a first offset member comprising:

a first side defining a first outside length extending inwardly a first distance from said at least one back support member toward the internal volume of said container; and a second side defining a first inside length extending inwardly a second distance from said at least one back support member toward the internal volume of said container, wherein said first inside length is greater than said first outside length; and a second offset member positioned below said first offset member, said second offset member comprising:

a first side defining a second outside length extending inwardly a third distance from said at least one back support member toward the internal volume of said container; and a second side defining a second inside length extending inwardly a fourth distance from said at least one back support member toward the internal volume of said container, wherein said second inside length is greater than said second outside length.

3. A container for transporting glass sheets in accordance with claim 2, wherein said back wall is substantially vertical and said first inside length and said first outside length define a first angle with respect to a plane defined by said back wall.

4. A container for transporting glass sheets in accordance with claim 3, wherein said second inside length and said second outside length define a second angle with respect to the plane defined by said back wall, wherein said first angle and said second angle are substantially similar.

5. A container for transporting glass sheets in accordance with claim 4, wherein said second angle is sized and oriented to facilitate accommodating a predetermined glass sheet curvature.

6. A container for transporting glass sheets in accordance with claim 4, wherein said second angle is within a range of approximately 3 degrees and approximately five degrees.

7. A container for transporting glass sheets in accordance with claim 6, wherein said second angle is approximately 4 degrees.

8. A container for transporting glass sheets in accordance with claim 2, wherein:

said first side of said first offset member defines an outside plane substantially parallel to said first and second side walls;

said first side of said second offset member is substantially coincident with said outside plane;

said second side of said first offset member defines an inside plane substantially parallel to said first and second side walls; and said second side of said second offset member is substantially coincident with said inside plane.

9. A container for transporting glass sheets in accordance with claim 2, wherein said foam rail support member is coupled to said first offset member and said second offset member such that said foam rail support member extends from said back wall at a predetermined offset angle.

10. A container for transporting glass sheets in accordance with claim 9, wherein said predetermined offset angle is approximately 5 degrees.

11. A method of assembling a container for transporting glass sheets, the container defines an internal volume, said method comprising:

providing a bottom structure having a front edge;

coupling a back wall to the bottom structure and extending the back wall upwardly therefrom;

coupling a first side wall to the back wall and extending the first side wall upwardly from the bottom structure;

coupling a second side wall to the back wall and extending the second side wall upwardly from the bottom structure, wherein the first and second side walls are opposite to each other; and coupling at least one back support member to the back wall and extending the at least one back support member in a substantially vertical direction;

forming at least one offset member comprising:

forming a first side of the at least one offset member having a first length; and forming a second side of the at least one offset member having a second length, wherein the second length is greater than the first length;

coupling the at least one offset member to the at least one back support member such that the first side extends inwardly a first distance from the at least one back support member toward the internal volume of the container, and the second side extends inwardly a second distance from the at least one back support member toward the internal volume of the container;

coupling a foam rail support member to the at least one offset member; and coupling at least one foam rail to the foam rail support member.

12. A method in accordance with claim 11, wherein forming at least one offset member comprises:

forming a first side of a first offset member on an outside portion of the first offset member facing the first side wall, the first side defines a first outside length extending inwardly a first distance from the at least one back support member toward the internal volume of the container;

forming a second side of the first offset member on an inside portion of the first offset member facing the second side wall, the second side defines a first inside length extending inwardly a second distance from the at least one back support member toward the internal volume of the container, wherein the first inside length is greater than the first outside length;

forming a first side of a second offset member on an outside portion of the second offset member facing the second side wall, the first side defines a second outside length extending inwardly a third distance from the at least one back support member toward the internal volume of the container; and forming a second side of the second offset member on an inside portion of the second offset member facing the first side wall, the second side defines a second inside length extending inwardly a fourth distance from the at least one back support member toward the internal volume of the container, wherein the second inside length is greater than the second outside length.

13. A method in accordance with claim 12, wherein:

coupling a back wall to the bottom structure comprises extending the back wall from the bottom structure is a substantially vertical direction; and forming a first side and a second side of the first offset member comprises defining a first angle with respect to a plane defined by the back wall.

14. A method in accordance with claim 13, wherein forming a first side and a second side of the second offset member comprises defining a second angle with respect to a plane defined by the back wall, wherein the first angle and the second angle are substantially similar.

15. A method in accordance with claim 14, wherein defining the first angle and defining the second angle such that the foam rail is oriented to facilitate accommodating a predetermined glass sheet curvature.

16. A method in accordance with claim 14, wherein defining the first angle and defining the second angle comprises defining the first and second angles with a value within a range of approximately 3 degrees and approximately five degrees.

17. A method in accordance with claim 16, defining the first angle and defining the second angle comprises defining the first and second angles with a value of approximately 4 degrees.

18. A method in accordance with claim 12, wherein:

forming the first side of the first offset member and forming the first side of the second offset member comprises defining an outside plane substantially parallel to the first and second side walls, wherein the first sides of the first and second offset members are substantially coincident thereon; and forming the second side of the first offset member and forming the second side of the second offset member comprises defining an inside plane substantially parallel to the first and second side walls, wherein the second sides of the first and second offset members are substantially coincident thereon.

19. A method in accordance with claim 12, wherein coupling a foam rail support member to the at least one offset member comprises coupling the foam rail support member to the first offset member and the second offset member such that the foam rail support member extends from the back wall at a predetermined offset angle.

20. A method in accordance with claim 19, wherein coupling the foam rail support member to the first offset member and the second offset member comprises extending the foam rail support member from the back wall at an offset angle of approximately 5 degrees.

* * * * *